US005272853A

United States Patent [19]

Francioni et al.

[11] Patent Number: 5,272,853

[45] Date of Patent: Dec. 28, 1993

[54] UNIT FOR SUPPLYING SHEET MATERIAL, FOR EXAMPLE, FOR SUPPLYING SHEETS OF CARDBOARD OR CARD TO AUTOMATIC PACKAGING MACHINES

[75] Inventors: Renzo Francioni, Prato Sesia; Duilio Pavese, Borgosesia, both of Italy

[73] Assignee: Cavanna S.p.A., Italy

[21] Appl. No.: 868,229

[22] Filed: Apr. 14, 1992

[30] Foreign Application Priority Data

Jun. 20, 1991 [IT] Italy ..... T091A000470

[51] Int. Cl.[5] ..... B65B 41/16; B65B 57/02

[52] U.S. Cl. ..... 53/64; 53/389.3; 53/389.4

[58] Field of Search ..... 53/505, 506, 64, 389.4, 53/389.3, 389.2; 242/58.1, 58.4, 58

[56] References Cited

U.S. PATENT DOCUMENTS 3,771,281 11/1973 Witte ..... 53/389.4 X
3,898,900 8/1975 Schmerund ..... 53/389.3 X
3,983,774 10/1976 Seragnoli ..... 53/389.3 X
3,995,791 12/1976 Schoppee ..... 53/389.4 X
4,467,589 8/1984 van Maanen ..... 53/389.4 X
4,541,221 9/1985 Seragnoli ..... 53/389.4 X

FOREIGN PATENT DOCUMENTS 1308665 2/1973 United Kingdom .

*Primary Examiner*—James F. Coan
*Attorney, Agent, or Firm*—Evenson, McKeown, Edwards & Lenahan

[57] ABSTRACT

The unit includes two stations, arranged in cascade, for supplying pieces of sheet material such as corrugated cardboard or card, one station being upstream of the other relative to an output conveyor line. The line is preferably horizontal with the stations arranged above it. The two stations operate alternately according to a predetermined sequence which takes account of the length of the portion of the output line between the two stations.

23 Claims, 2 Drawing Sheets

UNIT FOR SUPPLYING SHEET MATERIAL, FOR EXAMPLE, FOR SUPPLYING SHEETS OF CARDBOARD OR CARD TO AUTOMATIC PACKAGING MACHINES

BACKGROUND AND SUMMARY OF THE INVENTION

The present invention relates to units for supplying sheet material and has been developed with particular attention to its possible use as a unit for supplying sheets of cardboard or card to automatic packaging machines.

In this field of use there is often a need to form pieces from a sheet material of a certain thickness (for example, corrugated cardboard or smooth card) the pieces then being folded so as to be U-, C- or G-shaped or closed up so as to overlap in a generally closed arrangement to form structures for housing and supporting products such as food products. The folded sheet of cardboard or card is usually intended to constitute a support base or, in general, a protective framework for a group of articles packed in a wrapper of thin film material of the type currently known as a "flow-pack", a "form-fill-seal" pack, or simply an "ffs".

Plants which produce wrappers of this type operate at very high speeds (which tend to become ever faster with technological progress) and one aims to make their cycles absolutely continuous by preventing any disturbance leading to the interruption of the operation of the plant, even for a very short time.

One possible disturbance is the periodical running-out of the reel from which the sheet material used in the plant (typically the film which is intended to form the "flow-pack" wrapper, and in the context under consideration, the protective cardboard or card base) is unwound.

Several solutions have already been developed to solve this problem, that is, to prevent the "paper-changing" described above from disturbing the continuous operation of a packaging machine, particularly as regards the sheet material constituted by the thin film which is intended to form the aforementioned flow-pack wrappers. In this connection in particular, several solutions are known in which the end of a reel which is running out can be connected automatically to the beginning of a new reel so that, in practice, the packaging equipment is supplied with wrapping film which is theoretically endless, as a result of the automatic joining of the ends of successive reels of sheet material.

Solutions of this type are generally suitable for use with wrapping film which is very thin and flexible and, in most cases, is constituted by a material which can be welded easily either by heat-sealing or ultrasound welding (these techniques actually being used to seal the ends or flaps of the flow-pack wrappers).

The problem is quite different, however, when the sheet material is constituted by an intrinsically stiffer material such as, for example, corrugated cardboard or card. In particular, with such a material one cannot think simply in terms of automatically connecting the end of a reel which is running out to the beginning of the next reel. This is both because the connection is more difficult to achieve (in fact the materials are usually paper materials and not suitable for heat-sealing or ultrasound welding) and, in particular, because, in most cases, the material in question is quite thick and any connecting region formed by overlapping between two successive reels is in any case of considerable thickness and is readily perceptible as a defect.

In this particular field of use (the changing of the cardboard or card), therefore, semi-automatic solutions are conventionally used.

In practice, at least two supply reels are present in the unit for supplying the cardboard or card at any particular time, one reel acting as the supply reel whilst the other is a spare reel.

An operator notices (possibly because he has been alerted by a warning signal emitted automatically by the unit) that the reel currently in use is about to run out. At this point, the operator intervenes and rapidly unwinds the remaining portion of the sheet of cardboard or card on the reel which is running out so as to make a certain reserve of material available for supplying the machine and then takes the end of the first reel to a work table with which the supply unit is normally provided. The end of the reel which is running out is aligned on the table with the beginning of the new reel which is available close by and the two reels are then joined manually end-to-end by means of adhesive tape. When the packaging machine has used up the reserve formed, it automatically takes in the beginning of the new reel which then takes over the function of the supply reel. The operator can then fit a new reel which will act in turn as a new spare reel in the position previously occupied by the operative reel.

For various reasons, this solution cannot be considered wholly satisfactory.

In the first place, there is a very high probability that the region in which the end-to-end joining of the two ends of two successive reels has been effected will end up in a position in which it is clearly perceptible in the centre of one of the pieces into which the strip of cardboard or card is subsequently cut (usually by a rotary cutter).

In the second place, it is quite easy to unwind the reel which is running out and form a reserve when ribbed or corrugated cardboard is used (naturally with the corrugations or ribs arranged perpendicular to the direction in which the reel is unwound). This is because such a material tends to retain a certain spatial orientation quite well. It is quite difficult, however, to form a reserve with the use of smooth card, which is usually used for small articles.

Moreover, in view of the ever-increasing rates at which packaging machines currently operate, there is a risk that even a fairly large reserve (bearing in mind that the risk of the material in the reserve becoming entangled increases as its length increases) may be used up by the machine within a very short period of time, thus leaving the operator with very few seconds to form the joint.

In any case, the need for the intervention of an operator—in order to ensure the continuity of the operation of the machine rather than simply to replace a used reel with a new reel—is undesirable since, if the person responsible is distracted or temporarily unavailable for some reason at a certain moment, there is a risk of a stoppage of the machine.

The object of the present invention is therefore to provide a unit for supplying sheet material such as, for example, cardboard or card, which completely overcomes all the problems mentioned above.

According to the present invention, this object is achieved by virtue of a unit for supplying sheet material having the specific characteristics recited in the following claims.

The present invention is based, essentially, on the idea of incorporating two supply stations in cascade in the unit for supplying the sheet material, the two stations being able to supply the desired pieces of cardboard or card to a common output line (which is usually situated below them) and each station automatically taking over the supply operation from the other when the reel of sheet material in one of the stations runs out.

Other objects, advantages and novel features of the present invention will become apparent from the following detailed description of the invention when considered in conjunction with the accompanying drawings.

DETAILED DESCRIPTION OF THE DRAWINGS

Figure 1:
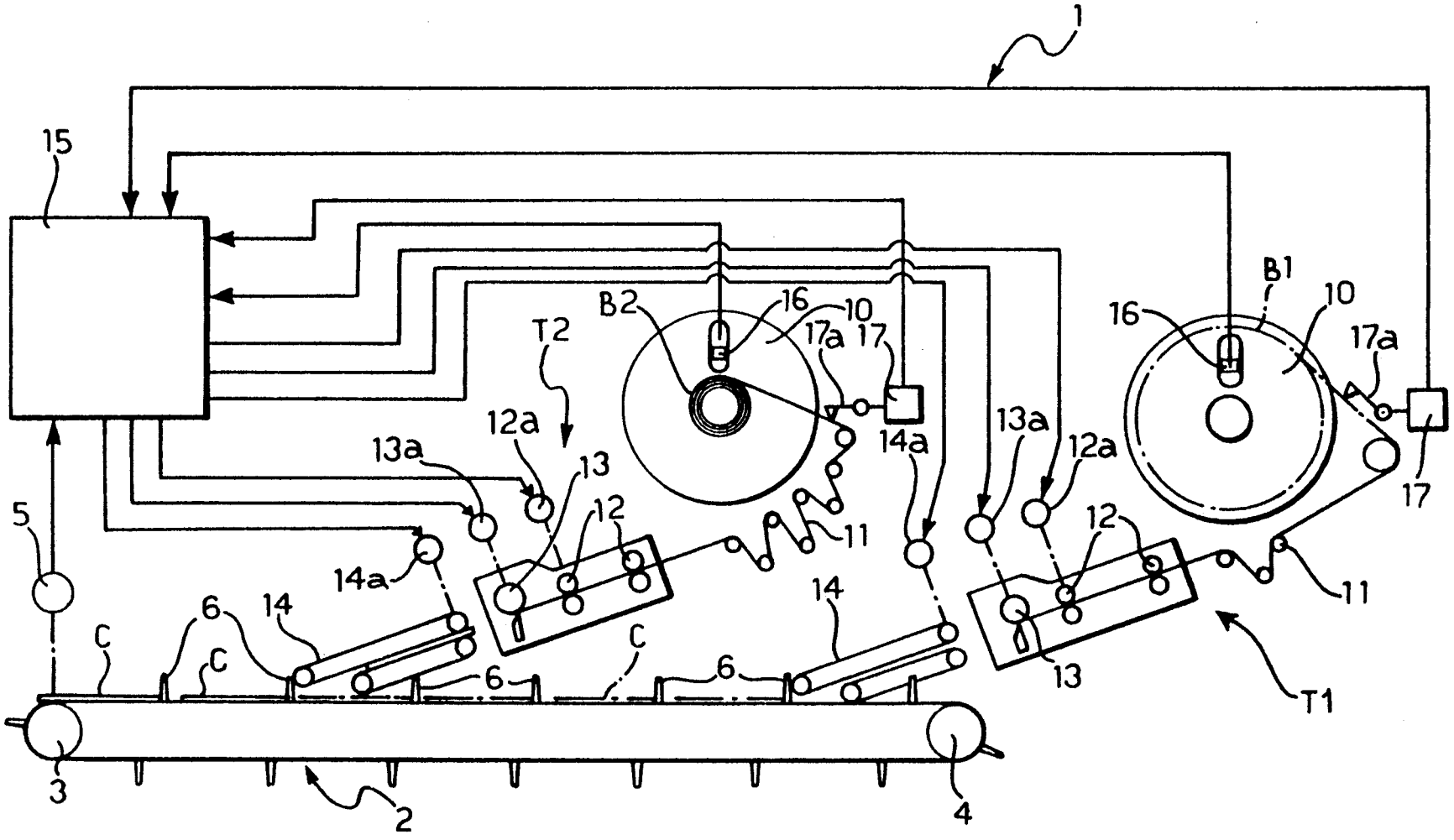
FIG. 1 is a schematic, elevational view showing the structure of a unit for supplying sheet material such as cardboard (for example, corrugated cardboard) or card, according to the invention.

In this drawing, a unit, generally indicated 1, is intended to be incorporated in a plant for the automatic packaging of articles, for example, food products, its function being to supply pieces C of sheet material of a predetermined length to an underlying motor-driven conveyor line 2. The line 2 is constituted, for example, by an endless chain which has end rollers or pulleys 3, 4, (one of which, for example, the pulley 3, is rotated by a motor 5) and entrainment formations (dogs or nibs) 6. In particular, the wheels or rollers 3, 4 are rotated anticlockwise as seen in FIG. 1, so that the upper active pass of the chain advances the pieces C of sheet material from right to left, again with reference to the orientation of FIG. 1, towards a further handling station constituted, for example, by a station in which articles (for example, confectionary products such as biscuits or chocolates), which are intended to be inserted further downstream in respective wrappers of the type currently knows as "flow-packs", are deposited on the pieces (or "cards") C.

The articles are deposited on the cards and the groups thus formed are wrapped in respective flow-pack wrappers according to criteria which are widely known in the art and do not therefore need to be described in detail herein.

The conveyor line 2, and its upper active pass in particular, extends substantially horizontally and the station 1 as a whole is disposed generally above the line 2. Although this arrangement is not essential, it has been found particularly advantageous for putting the invention into practice, particularly as regards the overall size of the unit and ease of access to its parts.

The unit 1 as a whole is constituted by two stations, indicated $T_1$ and $T_2$ respectively, associated with the line 2 in respective upstream and downstream positions (above the line 2).

As stated, with the arrangement of the parts shown in FIG. 1, the "cards" C are intended to be supplied from right to left.

With reference to this direction, the station $T_1$ (shown on the right) is consequently upstream of the station $T_2$ (shown on the left) and the station $T_2$ is thus downstream of the station $T_1$.

As regards their constitutent parts, the two stations $T_1$ and $T_2$ may be considered almost identical.

In particular, each station $T_1$ or $T_2$ includes:

a respective "magazine" 10 constituted, for example, by a reel-holder (usually a circular plate with a central hub which is intended to receive a further plate on its free end) which can hold a respective reel $B_1$, $B_2$ of sheet material (typically corrugated cardboard with the corrugations perpendicular to the direction in which it is unwound, or smooth card); in the momentary operating situation shown in FIG. 1, the cards C are being supplied from the station $T_2$, whose reel $B_2$ is running out, whilst the upstream station $T_1$ is the spare station with a new reel $B_1$ fitted in its magazine 10;

a set of rollers or similar formations 11 over which the sheet material coming from the magazine 10 passes so as to form a corresponding "reserve" of material; it will be noted that (for reasons which will become clearer from the following) the upstream station $T_1$ has a shorter, virtually non-existent reserve, whereas the reserve 11 of the downstream station $T_2$ is much longer;

one or more sets of contrarotating wheels or rollers 12 which are intended to have a certain transverse profiling effect ("profiling") on the sheet material, a cutting unit (usually a rotary cutter) 13 the function of which is to divide the continuous sheet coming from the respective magazine 10 into successive pieces of the desired length to form the cards C, and a set of entrainment members 14, for example, a group of motor-driven endless belts both above and below the path along which the cards advance, for advancing the cards from the cutter 13 towards the line 2.

As regards the presence of the components 10 to 14 described above, the structure of the units which supply cardboard or card in normal production packing machines is essentially reproduced in each of the stations $T_1$ and $T_2$. The structure of each of the stations $T_1$ and $T_2$ can therefore be considered known and such as not to require further detailed description herein.

For this purpose, it suffices to note that the creasing wheels or rollers 12 are intended to form fold lines in the sheet material which is supplied substantially flat from the reels $B_1$ and $B_2$, the sheet material subsequently being folded along the fold lines into a generally U, C or G-shaped configuration or a closed configuration according to the criteria mentioned above.

In practice, the active members which produce each crease are constituted by two contrarotating bodies (wheels or rollers) one of which has an annular rib with a V- or U-shaped profile on its periphery for cooperating with a complementary profile, that is a groove, in the other rotating member. As it passes between the rib and the groove, the sheet material is thus folded, at least locally, (causing a local collapse of the corrugated structure in the case of corrugated cardboard) so that the various portions of the cardboard can subsequently be oriented in a precise and reliable manner (by deflector members, not shown, situated downstream).

As stated, each pair of complementary creasing members 12 forms a respective crease.

If the cardboard is to be folded into a generally U-shaped configuration (two fold lines connecting the two side flaps of the cardboard to the central core portion), there are, therefore, generally two pairs of creasing wheels and the two wheels which are on the same side of the sheet (above it or below it) are usually keyed to a common shaft so that the two necessary creases are formed simultaneously and symmetrically.

If, for example, four creases are to be formed, however, (in order to form a card which is to bent so as to be C-shaped, with a central core portion for supporting the products from below, two side portions which protect the sides of the product, and a further two distal or top flaps which are intended to be folded over the upper face of the product) there are two rows of creasing members 12 (as in the embodiment illustrated). More precisely, there is a first row (upstream in the direction of advance of the cardboard) including two pairs of creasing wheels which form the first two creases connecting the central portion of the cardboard to the two side portions, and then a second row including two further pairs of complementary creasing wheels offset transverse the direction of advance of the sheet material from the creasing wheels of the first row, for forming the two outer creases connecting the side portions of the cardboard to the distal or top portions described above.

The function of the cutter 13 downstream of the creasing members 12 (arranged in one or more rows) is essentially to divide the continuous sheet of cardboard—as a result of a shearing action due to the orbital movement of the upper portion of the cutter which carries a blade—into successive pieces ("cards") the length of which (measured in the direction of advance of the sheet material) corresponds to the length of the article or articles to be deposited on the card.

Finally, as already stated, the function of the conveyor members 14 is to transport the cards thus formed to the line 2.

The members 12 (the creasing members), the member 13 (the cutter), and the members 14 (the supply belts) are intended to operate in synchronism and in a precise phase relationship both with each other and with the movement imparted to the line 2 by the motor 5.

For this reason, whenever the activation of the station $T_1$ or the station $T_2$ is mentioned in the description below and in the claims which follow, it should be assumed that this activation takes place in a synchronised manner for all the elements of the station and in the correct phase relationship with the nibs 6 of the conveyor line 2.

This could be achieved, at least in principle, by a positive mechanical linkage between the members 12, 13, and 14 and with the motor 5 and/or the line 2.

It seems preferable, however, for the members 12, 13 and 14 to have drive means which are physically independent of the motor 5 (and of the line 2) and are synchronised therewith by electronic means (according to widely known principles which do not need to be described specifically).

Moreover, the creasing members 12, the cutter 13 and the belt supply unit 14 are preferably driven by respective independent motors, indicated **12*a*, 13*a* and 14*a*** in the drawings.

This is because there may be situations—particularly during the replacement of the reels $B_1$ and $B_2$ in the stations $T_1$ $T_2$ and/or when the stations are being prepared for operation—in which it is desirable, for example, to advance the cardboard sheet between the creasing members 12 to enable it to be inserted in the station correctly without necessarily rotating the cutter 13, which could be dangerous.

Similarly, it may be desirable to advance the belt conveyors 14, for example, to remove pieces of card sheet which have remained therein, without necessarily having to advance the end of a new reel which has just been fitted in the ribbing members 12 if independent motors **12*a*, 13*a* and 14*a*** are available.

These results can easily be achieved by acting (in known manner), for example, on the central control unit 15 of the unit (constituted, for example, by a microprocessor or, preferably, by a so-called PLC) which oversees all the functions controlling the operation of the stations $T_1$ and $T_2$.

The PLC 15 is also supplied—from each station $T_1$ and $T_2$—with data supplied by two sensors 16 and 17 which are associated with the magazine 10 of each station and have the functions of detecting that the reel in the station is running out (the so-called "low paper" condition which is detected by the sensor 16) and that the reel is emerging from the end or tail of the sheet of cardboard wound thereon (the "out of paper" condition, which is detected by the sensor 17).

The sensor 16 may be constituted, for example, by an optical sensor situated at a predetermined distance from the axis about which the reel $B_1$ or $B_2$ unwinds in the magazine 10. When the diameter of the reel (which is determined by the thickness of the cardboard and the number of turns remaining to be unwound) falls below a predetermined level, the sensor 16 sends the PLC 15 a signal indicative of the fact that the reel is about to run out.

The sensor 17 may also be constituted by an optical sensor or even a mechanical feeler **17*a* which is disposed on the path along which the sheet of cardboard unwinds from the reel $B_1$ or $B_2$ and can detect the fact that the sheet of cardboard taken from the reel $B_1$ or $B_2$ is finished (for example, because a light or infra-red beam which was previously intercepted by the sheet of card is now propagated freely to a detector member 17*a***, or because a feeler member which was previously supported by the sheet of card unwinding from the reel has fallen).

Each sensor 17 is located at a predetermined distance from the point at which the supply unit 14 of the respective station $T_1$ or $T_2$ transfers the cards 2 which have passed through the creasing members 12 and been cut by the cutter 13 to the underlying line 2.

If one takes account of the length of the respective reserve 11, it is therefore possible to determine how many more complete cards the respective station $T_1$ or $T_2$ can supply to the line 2 after the sensor 17 has detected that the sheet of cardboard has run out.

When the sensor 17 of the station $T_1$ detects that the sheet of cardboard unwinding from the reel $B_1$ is finished, it therefore sends a respective warning signal to the PLC 15 which can thus establish that, from that moment, the station $T_1$ can supply a certain predetermined number, indicated $N_1$, of further complete pieces of card to the line 2.

Similarly, when the sensor 17 associated with the station $T_2$ sends a corresponding signal to the PLC 15, the PLC 15 will be able to establish that, from that moment, the station $T_2$ can supply, for example, a further $N_2$ complete cards.

As stated in the introduction to the present description, the stations $T_1$ and $T_2$, which are otherwise completely identical, differ as regards the lengths of the reserves formed by their transmission members 11. $N_2$ is therefore generally larger than $N_1$.

The size of the difference is determined, in practice, by the distance by which the two stations $T_1$ and $T_2$ are offset, one upstream of the other on the line 2.

In general, it will be assumed that the point at which the upstream station $T_1$ supplies the cards C to the line 2 is upstream of the point at which the cards C are supplied by the station $T_2$ by X positions, the position units being determined by the distance separating two successive nibs of the line 2.

It is clear from the foregoing that the numbers $N_1$, $N_2$ and X are generally variable—for given overall dimensions of the unit 1—in dependence on the lengths of the cards C measured in their direction of advance. In particular, it will be appreciated that this length also determines the distance between the nibs 6 of the chain 2, which is generally changed when the dimensions of the cards C to be produced are changed. Similarly, the conditions for the synchronisation and relative timing of the members 12, 13 and 14 are also modified selectively—by electronic means and according to known criteria—with variations in these dimensions.

In general, however, $N_2 \geqq N_1 + X$.

In the sense in which an equal relationship is described, the expression given above expresses the fact that the distance (measured in modules, that is in cards C) between the sensor 17, which detects that the sheet of cardboard in the downstream station $T_2$ has run out, and the point at which that station supplies its cards to the line 1 (including the length of the respective reserve 11) must be equal to the corresponding distance measured from the sensor 17 in the upstream station $T_1$.

This means that, in practice, the distances between the points at which the sheets of cardboard are supplied from the magazines 10 of the two stations $T_1$ and $T_2$ and the point of convergence of the flows of cards C supplied by the two stations to the line 2 must be identical for both stations.

In the sense in which an unequal relationship is described, the expression given above expresses a concept according to which, when it is detected that the reel $B_2$ in the station $T_2$ has run out, the station $T_2$ must still be able to supply the line 2 with enough cards 2 to enable the station $T_1$, which is taking over the supply of the cards from the station $T_2$, not only to bring its cards to the supply point on the line 2, but also to fill with cards the X positions in the line 2 which separate the station $T_1$ from the station $T_2$. In the reverse situation, there will actually be one or more positions lacking for the flow of cards C supplied to the stations further downstream.

Figure 2:
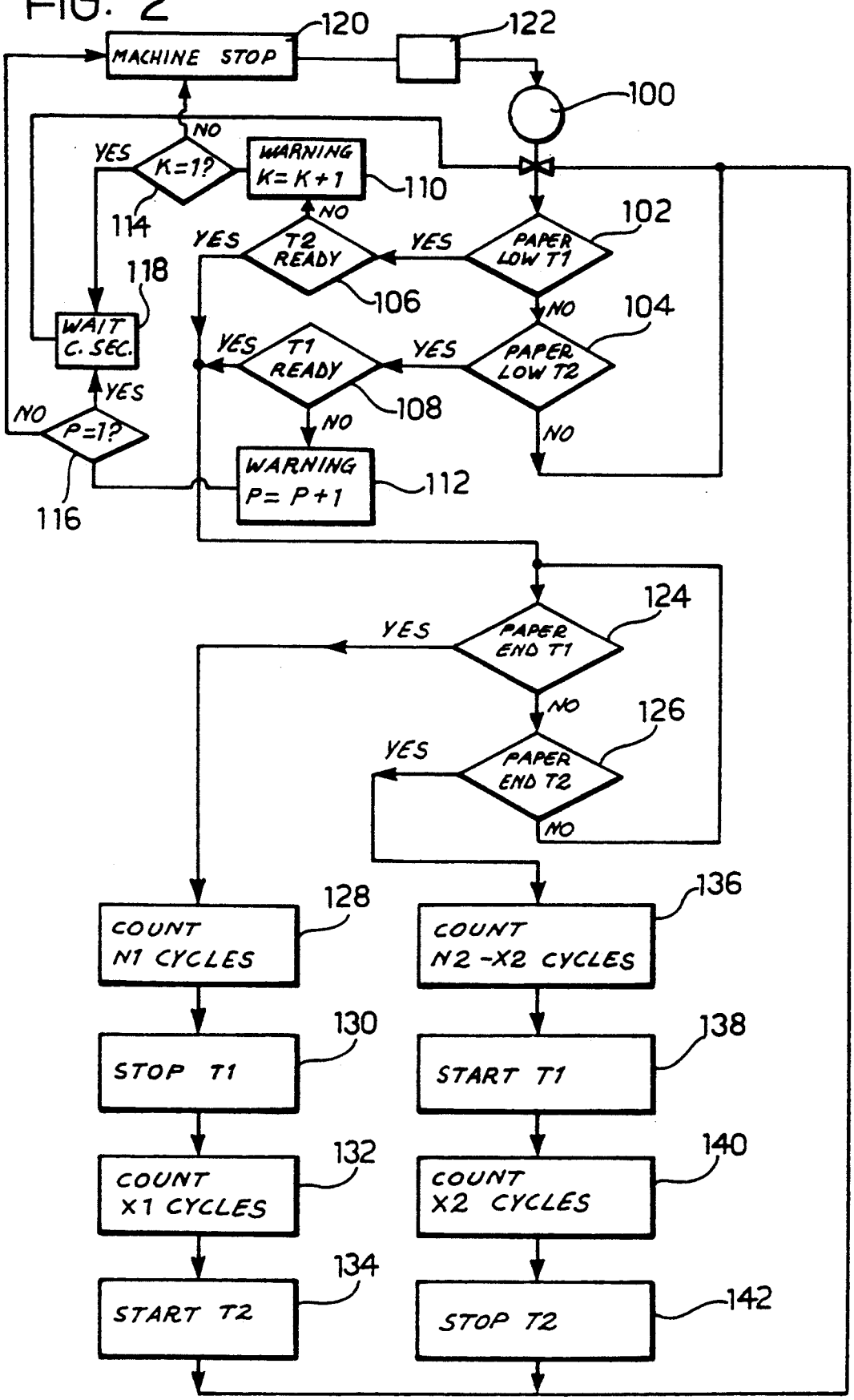
FIG. 2 shows the criteria regulating the operation of the unit of FIG. 1, in the form of a flow chart.

The PLC 15 controls the operation of the stations $T_1$ and $T_2$ according to a programming sequence such as that shown—purely by way of non-limiting example—by the flow chart of FIG. 2.

As already stated above, in the description of this operating sequence, it will be assumed (for simplicity) that the activation of the stations $T_1$ and $T_2$ implies the simultaneous and synchronous activation of the respective drive members 12*a*, 13*a* and 14*a*. As already stated, the synchronous and simultaneous activation of these members generally constitutes a running situation, whereas in fact, during the activation stage and—in particular—during the preparation of the station for operation, these members may be activated separately. In any case, the relative details are not relevant for the purposes of putting the invention into practice.

The top portion of the chart of FIG. 2 shows a first sequence of instructions which starts with a starting step 100 and whose function is essentially to ensure that the station which is not being used to supply the cards C to the line 2, at the time in question, is ready to take over from the other station as soon as necessary.

For this purpose, the PLC 15 detects the signals supplied by the sensors 16 and establishes (tests 102 and 104) if one of these sensors indicates that the level of the reel in its station is below the level which indicates that the reel is about to run out.

If the results of both these tests are negative, the PLC 15 finds that the levels of the reels in both stations are adequate and then goes through the same steps again.

If there is a positive result to one of the steps 102 or 104, the PLC 15 immediately proceeds to check (steps 106 and 108) whether the other station has an adequate reel level. In practice this test is intended primarily to ascertain that the station which is inactive, at the time in question, is ready to take over the function of supplying the cards C from the active station. An indication to this effect may be supplied to the PLC 15 by the operator who, for example, has inserted a new reel and located the end of the reel correctly through the creasing members 12, the cutter 13 and the belts 14.

If the result of the respective test is positive, the PLC 15 goes on to interchange the stations in the manner which will be explained further below.

If, when one station is about to run out, the PLC 15 detects that the other station has not yet been made ready for operation, the PLC 15 emits an external warning (steps 110, 112). For example, this may be a warning which appears on a display associated with the PLC 15, or more preferably, an alarm signal which is more readily perceptible, such as the lighting of a lamp, possibly accompanied by a sound signal. At the same time, the PLC 15 increases a count factor (P in the case of the station $T_1$, or K in the case of the station $T_2$) which is intended to establish whether the warning emitted at the time in question is the first warning or whether it falls within a certain band constituting the maximum number of warnings which can be tolerated before the respective station $T_1$ or $T_2$ is ready to operate.

If it is the first warning, or if it falls within the band considered tolerable (which is ascertained by further test steps 114 and 116—with positive results) the PLC 15 is disposed in a waiting phase (step 118) the duration of which relates to the time normally required for the operator to prepare for operation the station which is to take over from that which is supplying the cards C at the time in question when the sheet of cardboard therein runs out.

When the waiting period has elapsed, the PLC 15 goes back to the detection steps 102 and 104 with a view to progressing generally towards a positive result to the test step 106 or 108 which will occur first.

If, however, it is found in one of the steps 114, 116, that the station which is intended to replace the station which is supplying the cards C to the line 2, at the time in question, is not yet ready to operate and that the warning in question is not the first and that the band of warnings considered tolerable has been exceeded, the system goes on to a more serious warning step (step 120) indicating externally, in short, that there is a risk of a stoppage of the machine because, once the station which is supplying the cards C, at the time in question, has run out the other station will probably not be able to take over.

Obviously this situation requires immediate intervention or may even result in an automatic, preventative stoppage of the machine to reduce the adverse effects of an interruption in the flow of cards C.

The system can generally be restarted after the step 120 only by the positive resetting of the entire system (the resetting step 122) which sends the whole system back to the initial step 100.

In order further to illustrate the operation of the unit 1, it will now be assumed that the step 106 or 108 concerned at the time in question has given a positive result, indicating, on the one hand, that the level of the reel in one of the stations ($T_1$, $T_2$) is becoming low, thus indicating that the the sheet of cardboard will soon run out and, on the other hand, that the other station ($T_2$, $T_1$) is ready for operation.

At this point, the PLC 15 continues to operate the machine normally until a respective test (124 or 126 according to the station concerned, that is, the station in which the sheet of cardboard is running out) indicates, as a result of the receipt of a signal from the respective sensor 17, that the sheet of cardboard taken from the respective reel has run out.

If one assumes, first of all that, at the time in question, the station $T_1$ is operating with its cardboard running out and the station $T_2$ is ready to take over the function of supplying the cardboard, the comparison step in question will be the step indicated 124.

At this point, the system keeps the operation of the station $T_1$ unchanged so that it supplies cards C for a further $N_1$ cycles, that is as long as the station $T_1$ in question can supply complete cards to the line 2. Any ends or partial pieces, however, will be retained in the belt unit 14 from which they can be removed by the operator who reloads and resets the station $T_1$ for operation.

After the station $T_1$ has been kept in operation for a further $N_1$ cycles (step 128) the PLC 15 stops the station $T_1$ (step 130) without, however, simultaneously starting the station $T_2$.

This is because the last X cards already supplied by the station $T_1$ are downstream of the station $T_1$ but still upstream of the station $T_2$. The PLC 15 therefore starts the station $T_2$ (step 134) only after it has counted a certain number $X_1$ of cycles (step 132) and the station $T_2$ then starts to supply its cards C to the line 2.

It will be noted that the counting step 132 may last for a number $X_1$ of cycles which is not necessarily equal to the number X which identifies the number of conveyor positions of the line 2 between the two stations $T_1$ and $T_2$. The number $X_1$ is usually one or more units less than X; this is mostly to take account of the fact that the stations $T_1$ and $T_2$ are not necessarily "loaded" for taking over the supply function so as to have a card C ready for transfer immediately to the line 2 as soon as the station is started. The station must consequently be started one or more units in advance (hence $X1 \leqq X$) so as to ensure that the first card is supplied correctly to the line 2 immediately behind the last card supplied by the other station.

In any case, for the purposes of a general understanding of the invention, reference may simply be made to a value of $X_1$ which, in all respects, is equal to X.

Once the unit 1 has thus started to operate (with the station $T_2$ supplying and the station $T_1$ stopped and being reset by the removal of the core of the reel $B_1$ which has run out, the loading of a new reel, the insertion of the end of the sheet of cardboard through the reserve 11, and the creasing members 12, the cutting of a "clean" front edge by the cutter 13, the correct timing of the different involved parts), it continues until, as the program described above progresses, the comparison step 126 gives a positive result indicating that the reel $B_2$ has run out so that the station $T_1$ must be made to intervene to replace the station $T_2$.

For this purpose, the PLC 15 starts a counting step 136 for a number of cycles equal to the difference between $N_2$ (the number of further complete cards C which the station $T_2$ can supply to the line 2) and a factor $X_2$. This factor identifies the number of cycles for the supply of individual pieces of card C which the station $T_1$ must be made to perform, after it has started, in order to fill the portion of the line 2 between the two stations $T_1$ and $T_2$ with cards C; in practice, this is the number of operating cycles which the station $T_1$ must perform after it has been started in order, so to speak, to place a card C in the position of the line 2 immediately upstream of the station $T_2$ which has stopped supplying its cards.

In general $X_2$ will be greater than X, since the station $T_2$ does not generally supply a card to the line 2 immediately after it has been started.

For the purposes of an understanding of the general operating principle of the invention, however, $X_2$ may in fact be identified as X.

Upon completion of the counting step 136, the PLC 15 therefore starts the station $T_1$ (step 138) without, for the moment, stopping the station $T_2$, which continues to supply its remaining cards C to the line 2.

The PLC 15 stops the station $T_2$ (step 142) only after it has completed a further step in which it counts $X_2$ cycles (step 140), the station $T_2$ then being ready for resetting so that it can take over again from the station $T_1$ in the manner described above when its reel $B_1$ has run out.

A comparison of the sequences represented by the steps 128 to 134, on the one hand, and by the steps 136 to 142, on the other hand, shows substantially the following situation.

When the station $T_2$ has to take over from the station $T_1$, it is started a certain period of time (X, or more precisely $X_1$ cycles) after the moment at which the station $T_1$ stops. This enables the series of cards C still being supplied on the portion of the line 2 between the two stations by the station $T_1$ to be used up.

When the station $T_1$ has to take over from the station $T_2$, on the other hand, there is a certain period of time (or, more precisely $X_2$ cycles) during which the station $T_1$ operates before the station $T_2$, which has run out, is stopped, for enabling the station which is taking over to fill the space constituted by the portion of the line 2 between the two stations $T_1$ and $T_2$.

Naturally, the principle of the invention remaining the same, the details of construction and forms of embodiment may be varied widely with respect to those described and illustrated, without thereby departing from the scope of the present invention. This applies in particular as regards the possible application of the invention to sheet materials other than corrugated cardboard or card, to which the present description relates by way of example; for example, a solution according to the invention could be used to supply a continuous flow of pieces of aluminium foil for wrapping articles such as pralines, chocolates and the like.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A unit for supplying pieces of sheet material continuously to an output conveyor line, wherein the unit includes:

first and second stations for supplying the pieces, the stations being arranged upstream and downstream with respect to each other, relative to the conveyor line and having respective magazines for the sheet material which may run out as a result of the operation of the respective station, sensor means for detecting when the magazines of sheet material in the first and second stations run out, and control means responsive to signals generated by the sensor means, for operating the first and second stations in alternation so that the supplying of pieces of sheet material continues without interruption due to exhaustion of the respective magazines of said first and second stations;

said control means including means for stopping said first stations a predetermined period of time before the second station is activated, and for starting said first station a predetermined period of time before the second station is stopped.

2. A unit according to claim 1, wherein further sensor means associated with the magazines of the first and second stations can detect the condition in which the respective magazine is about to run out, and in that the control means are sensitive to the signals produced by the further sensor means and are configured so as to check, when one of the stations is about to run out, that the other station is ready to operate.

3. A unit according to claim 2, wherein the sensor means include optical or mechanical sensor means for detecting the passage of the end of the sheet of material housed in the respective magazine.

4. A unit according to claim 2, wherein the further sensor means include a sensor sensitive to the volume of sheet material still present in the respective magazine.

5. A unit according to claim 4, wherein the magazine houses a reel of the sheet material, and in that the further sensor means are generally sensitive to the diameter of the reel.

6. A unit according to claim 2, wherein the further sensor means include optical sensors.

7. A unit according to claim 4, wherein the further sensor means include optical sensors.

8. A unit according to claim 5, wherein the further sensor means include optical sensors.

9. A unit according to claim 1, wherein the output line is substantially horizontal.

10. A unit according to claim 1, wherein the first and second stations are arranged in positions generally above the conveyor line.

11. A unit according to claim 10, wherein the output line is substantially horizontal.

12. A unit according to claim 1, wherein the first and second stations include members for handling the sheet material, selected from the group constituted by:

means (so-called creasing means) for folding the sheet material at least locally, cutting means for dividing the sheet material into consecutive pieces, and conveyor means for transporting the sheet material towards the output line.

13. A unit according to claim 12, wherein the members for handling the sheet material each have independent drive means.

14. A unit according to claim 1, wherein the first and second stations are separated a distance comprising a given number of positions for transporting the pieces of sheet material on the output line, and in that the control means are configured in a manner such that:

A) when the sensor means detect that the magazine in the first station is running out, the control means put into effect an operating sequence including, in order, the steps of:

keeping the first station in operation for a first number of cycles for the supply of pieces of sheet material to the output line, stopping the first station, waiting for a second predetermined number of cycles for the supply of pieces of sheet material to the output line, and starting the second station, and B) when the sensor means detect that the magazine in the second station has run out, the control means put into effect an operating sequence including, in order, the steps of:

keeping the second station in operation with the first station stopped for a third number of cycles for the supply of pieces of sheet material to the output line, starting the first station, keeping the second station in operation for a fourth number of cycles for the supply of pieces of sheet material to the output line, and stopping the second station.

15. A unit according to claim 14, wherein the second number and the fourth number are equal to each other and to the number of conveyor portions on the output line.

16. A unit according to claim 14, wherein the difference between each of the second and fourth numbers and the number of conveyor portions on the output line is determined by the number of cycles for which the respective station must be activated before it actually supplies a respective piece of sheet material to the output line.

17. A unit according to claim 16, wherein the fourth number is larger than the second number.

18. A unit according to claim 14 wherein:

the first number is determined by the number of further complete pieces of sheet material which the first station can supply to the output line after its magazine has run out, the second number and the fourth number are determined by the separating distance, that is, the distance comprising a given number of positions for transporting the pieces of sheet material on the output line, and the third number is determined by the difference between the number of further whole pieces of sheet material the second station can supply to the output line after its magazine has run out.

19. A unit according to claim 1, wherein the sensor means include optical or mechanical sensor means for detecting the passage of the end of the sheet of material housed in the respective magazine.

20. A unit according to claim 1, wherein the first and second stations have respective means for accumulating respective portions of sheet material within the station, and in that the means for accumulating the sheet material in the second station hold a portion of sheet material generally longer than the corresponding portion held by the accumulation means of the first station.

21. A unit according to claim 20 wherein the first and second stations are separated by a portion of the output line of predetermined length, and in that the accumulation means associated with the second station accumulate a portion of sheet material the length of which is at least equal to and preferably longer than the sum of the length of the corresponding portion of sheet material accumulated by the accumulation means of the first station and the predetermined length of the predetermined portion of the output line.

22. A unit according to claim 1, wherein at least the downstream station includes a reserve structure for accumulating a certain portion of sheet material within the station.

23. A unit according to claim 22, wherein the first and second stations have respective means for accumulating respective portions of sheet material within the station, and in that the means for accumulating the sheet material in the second station hold a portion of sheet material generally longer than the corresponding portion held by the accumulation means of the first station.

* * * * *